United States Patent [19]

Abbott

[11] Patent Number: 4,460,089

[45] Date of Patent: Jul. 17, 1984

[54] PROTECTIVE CASE FOR A SECOND STAGE BREATHING APPARATUS

[76] Inventor: Keith Abbott, 2029 #1803, Park Pl., Bedford, Tex. 76021

[21] Appl. No.: 388,039

[22] Filed: Jun. 14, 1982

[51] Int. Cl.[3] ..... A62B 7/00; B63C 11/16; A45C 11/00; B65D 85/00

[52] U.S. Cl. ..... 206/527; 206/349; 150/55; 128/202.13; 128/204.26; 220/4 B; 220/339

[58] Field of Search ..... 206/527, 525, 349; 220/4 B, 4 E, 339; 150/52 R; 128/204.13, 203.12, 202.13, 202.14, 204.26

[56] References Cited

U.S. PATENT DOCUMENTS

| | | | |
|---|---|---|---|
| 2,510,712 | 6/1950 | Olowinski | 128/203.12 |
| 3,038,558 | 6/1962 | Plummer | 150/52 R |
| 3,213,960 | 10/1965 | Wagner | 150/52 R |
| 4,079,735 | 3/1978 | Gaffney | 128/204.18 |
| 4,142,565 | 3/1979 | Plunket, Sr. | 24/204 |

*Primary Examiner*—William T. Dixson, Jr.
*Attorney, Agent, or Firm*—Sherman Levy

[57] ABSTRACT

A case is provided for protecting a second stage breathing apparatus such as those used in underwater scuba diving equipment. The case is in the nature of a device for keeping the second stage breathing apparatus clean and for protecting the same and for completely covering the second stage of a diver's two-stage diving apparatus. The case includes a member made of a yieldable or resilient material such as a suitable plastic, rubber-like compound or the like, and the case includes a hinge construction for permitting opening and closing of the case, and wherein there is also provided a fastener for maintaining the case in closed position until it is to be opened, and there is also provided a ring-like member for permitting the diver to attach the case to a belt or strap worn while diving. The internal configuration of the case is such that the second stage breathing apparatus is snugly and properly received therein.

18 Claims, 5 Drawing Figures

PROTECTIVE CASE FOR A SECOND STAGE BREATHING APPARATUS

BACKGROUND OF THE INVENTION

In accordance with the present invention there is provided a case which will completely cover the second stage of a breathing apparatus. Each part or section of the regulator has a designated area of insertion, and a hinge on the bottom of the case permits the case to be opened widely so that by fitting any one of the pieces into place, a diver need only close the case for proper placement. A suitable fastner, such as a velcro strap, is arranged opposite the hinge for selectively maintaining the case in closed position. A "D"-ring permits the diver to attach the case to a belt or strap worn while diving so that the case is convenient and useful for keeping clean and protecting an auxiliary breathing apparatus while under water.

1. Field of the Invention

The present invention relates to underwater scuba diving equipment, and more particularly to a device or case for maintaining a second stage breathing apparatus clean and for protecting the same because the second stage of a diver's two-stage breathing apparatus is completely covered when required or desired.

The case of the present invention provides a safe construction for the second stage breathing apparatus because it completely covers the second stage of a regulator whereby the entire second stage will be maintained free from foreign matter.

2. Prior Art Disclosures

The following patents are of interest, but these prior patents, whether taken individually or collectively with each other are not believed to affect the patentability of the present invention.

U.S. Pat. No. 4,079,735, John P. Gaffney, EMERGENCY AIR BREATHING ASSEMBLY FOR DIVERS, U.S. Pat. No. 3,768,465, Norman D. Helmer, ATHLETIC MOUTH PROTECTOR APPARATUS.

SUMMARY OF THE INVENTION

An important object or aspect of the present invention is to provide a protective case for a second stage breathing apparatus which is safer than previous devices known because it completely covers the second stage of a regulator and will keep the entire second stage free of foreign matter.

A further object of the present invention is to provide a protective case for the second stage breathing apparatus which completely covers the second stage and guards the second stage against scratches and dents and wherein the case can be used with both standard second stage and an emergency second stage.

Another object of the present invention is to provide a protective case that provides additional protection on the beach to guard against sand and rocks in case of accidental dropping and wherein the device can also be used while in a gear bag during transportation or during storage.

A still further object of the present invention is to provide a protective case for a second stage breathing apparatus which is constructed to completely cover the second stage of a breathing apparatus wherein each basic piece of the regulator has a designated area of insertion.

A still further object of the present invention is to provide a protective case for a second stage breathing apparatus wherein the case has a hinge on the bottom which permits the case to be opened widely, and whereby fitting any one of the pieces into place, a diver would only need to close the case for proper placement, there being a fastener, such as a velcro strap, arranged opposite the hinge for maintaining the case in a selective closed position, and wherein a "D"-ring permits a diver to attach the case to a belt or strap worn while diving so that the case is useful for keeping clean and protecting an auxiliary breathing apparatus while underwater and the like.

A still further object of the present invention is to provide a protective case for a second stage breathing apparatus that has improved characteristics and advantages as compared to previous protective cases.

Still another object of the present invention is to provide a protective case for a second stage breathing apparatus that is generally rugged in construction and inexpensive to manufacture and efficient to use.

Other objects and advantages of the present invention will become apparent in the following specifications when considered in light of the attached drawings.

DESCRIPTION OF THE PREFERRED EMBODIMENT

Figure 1:
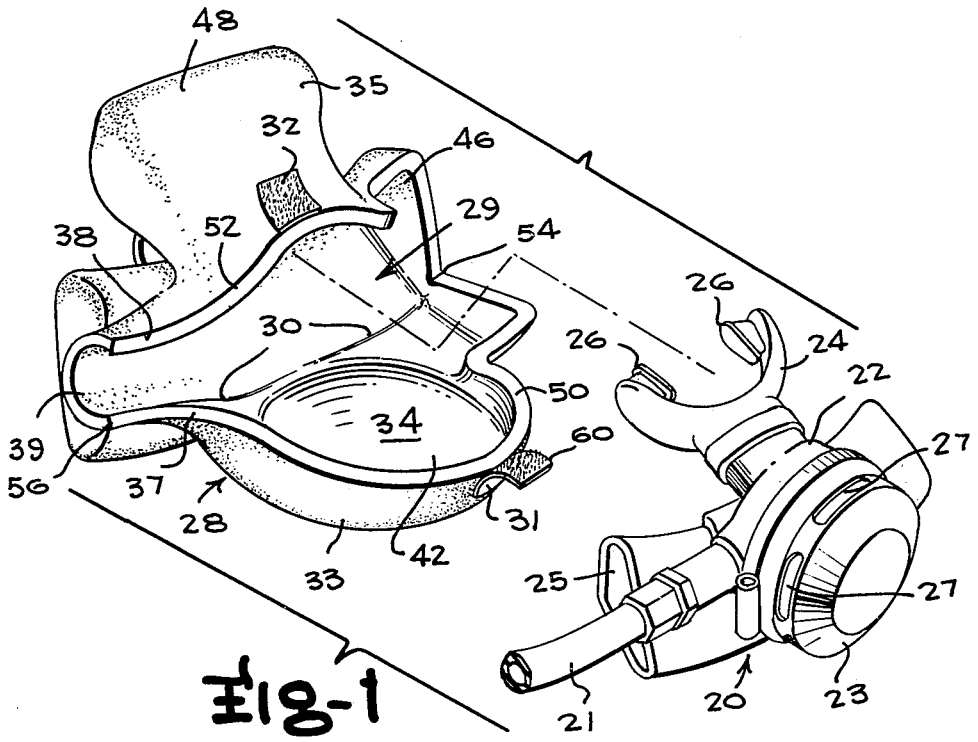
FIG. 1 is a perspective view showing the case in open position.

Referring in detail to the drawings, the numeral 20 indicates a conventional second stage breathing apparatus which is supplied with air through a hose 21 leading from a first stage that is adapted to be connected to a standard tank of air worn by the diver on the back. For reasons of clarity, the first stage and tank are not shown in the drawings. Further, the second stage 20 consists of a main body 22 which contains most of the working parts and there are three main components which are integral with the body 22. These three main components are the box top 23, the mouthpiece 24, and the exhaust port 25, FIG. 1.

As shown in the drawings the mouthpiece 24 is semicylindrical in configuration and has flanges that are adapted to be placed between the teeth and lips of the user and which are held in place with bits 26 during use thereof. Further, the mouthpiece 24 contains an opening which provides a means of supplying air to the diver. The mouthpiece is arranged or located in the upper rear portion of the main body as shown in the drawings.

It will be noted that the box top 23 has a generally rounded formation somewhat of a saucer shape and has oval water inlet ports 27 which surround the outer region or edge. The box top 23 is located in the forward or front part of the main body as shown in the drawings.

With further reference to the drawings, the exhaust port 25 is tubular in configuration and has openings at either end to permit exhaled air to escape the regulator into the surrounding water and the same in place in the lower area of the main body.

In accordance with the present invention there is provided a protective case 28 which is adapted to be made of a suitable material such as a yieldable or resilient plastic, rubber-like compound or the like, and the case 28 is generally the same configuration as the second stage breathing apparatus 20 and the case 28 has specified areas for each of the three main parts of the regulator to be placed therein. As shown in FIG. 1, when the case 28 is opened, there is provided an open area 29 which permits insertion of the regulator and this is made possible due to the provision of a hinge portion 30 as well as due to the inherent resiliency of the case 28.

It will be seen that the case 28 can be held closed by a common velcro strap 31 until ready for use, and a portion of the strap 31 extends outwardly beyond the case to provide for quick opening in an emergency situation. The velcro portion 31 is adapted to co-act with a corresponding velcro portion 32. It will be noted that with the box top laid into place in a designated area, a diver need only close the case and therefore cause the mouthpiece and exhaust portion to correctly fit into place in the areas previously described.

With further reference to the case 28, it will be seen that the case includes first and second sections or portions 33 and 35, the case 28 being an integral one-piece construction made of a rubber-like or plastic-like resilient or yieldable material. These sections 33 and 35 are integrally joined together by hinge portion 30. The section 33 has a recessed or hollow interior as in 34, FIG. 1, and the section or portion 35 has a recessed or hollow interior 36 and this construction provides a proper receiving space for the various parts of the second stage apparatus 20. The flanges or shoulders 37 and 38 are provided on the portions 33 and 35 so that when the case is in closed position, the flanges 37 and 38 abut or are contiguous to each other so that safe closure is provided for the device. The case 28 further includes an aperature or opening 39 for the projection therethrough of the hose 21.

The parts can be made of any suitable material and in different shapes or sizes as desired or required.

From the foregoing, it will be seen that there has been provided a protective case for a second stage breathing apparatus. The present invention relates to underwater scuba diving equipment and more particularly to a device to keep clean and protect by completely covering the second stage of a diver's breathing apparatus.

As is known, diving is an art which allows the participant to float as if suspended without gravity, with access to air. Freedom of movement and weightlessness are two of its most attracting features, along with permitting a person to view oceans, lakes, springs, or rivers from a point of view of fish or the like. Further, diving has become a sport not only loved by professionals, but also amateurs and curiosity seekers are involved with the same.

Careful training has become a must with this large movement toward scuba diving as a sport. As is known, national organizations have improved their standards and do their best to let the new diver know exactly what awaits him or her both on the surface in preparation, and underwater in practical application of learned skills.

A new student is required to seek this training to engage fully and safely in the sport. Training consists of the underwater environment, safety procedures, as well as the proper care and maintenance of equipment. A wide variety of equipment is needed: for example, wet suits for protection against cold and abrasions; a weight belt and buoyancy compensator to compensate for buoyancy at any depth; a watch and compass to regulate time, direction and distance; a depth gauge to regulate pressure, allowing the diver to surface at a proper rate of ascent to prevent maladies or sickness; and of necessity a regulator to allow proper breathing at any depth. This gear may be rented or purchased, but most divers prefer to purchase their own gear, and all of this gear is usually stored in a large nylon bag known as a gear bag or storage bag.

To prevent damage to delicate gear proper packing of the bag is essential. One of the most delicate pieces of gear and also one of the more expensive, is the conventional two stage regulator. The working parts of this regulator consist of small springs, diaphragms, and "O"-rings that can be damaged easily. Damage may be caused by uncareful handling, or foreign matter entering the regulator through exhaust ports, water inlet ports, the box top, or the mouthpiece. It is to be noted that most divers prefer to warp the second stage of this two stage regulator in a towel or other soft cloth when packing a gear bag for storage or transportation because this second stage is the more delicate part of the assembly. Further, the regulator may also be damaged in transport from a gear bag to a dive site or other location. Since the water's edge of a dive site is rarely accessible by automobile, a diver, opting to leave the gear bag in the vehicle to prevent theft while underwater, must carry all gear from the vehicle to the entry point of the dive and during this move regulators are subject to damage. Further, accidental bumping or banging against trees, rocks, or even man-made constructions may cause internal damage leading to malfunction of the equipment.

In some cases this damage may not be realized or evident until the diver is underwater, which creates a hazardous situation to the diver's safety. Poor handling of the second stage, such as dragging it through tall grass, dropping or laying the regulator in sand or mud, allows foreign particles to enter through exhaust ports, water inlet ports in the box top, or the mouthpiece which may lead to jamming or malfunction. This will also disfigure the external looks of an expensive piece of equipment.

As is known, all who become involved in the sport are trained in safety procedures and safety equipment used while in the water, and among this type of equipment is an auxiliary breathing apparatus commonly referred to as an octopus. This is simply an extra second stage for this two stage regulator and has become very popular with persons using the same.

It is known that when distractions or problems arise causing a diver to run out of air the octopus will prove to be an invaluable piece of equipment. With a buddy nearby, the diver out of air will simply take hold of the octopus on his buddy's tank and use this as a source of air, and this will permit both divers to breathe at the same time from one tank of air and permit such persons to reach the surface safely. Although a valuable and useful piece of equipment, there has been a problem as to proper and convenient carrying of the octopus until the same is needed or required.

A case is needed in order to protect this valuable instrument, whether it is in use underwater, such as the octopus; or on the beach; or stored in a gear bag. A case such as the case 28 will protect the regulator from sand, scratches or any other obstacles that would mar its appearance and durability or obstruct its perfect performance during use.

The purpose of the present invention is to solve the foregoing problems and to enhance safety and pleasure among those in the diving world as previously noted.

As shown in the drawings, the second stage breathing apparatus 20 is supplied with air through a hose 21 that leads from first stage connected to a standard tank of air worn on the back of the diver. First stage and tank are not shown since they are of conventional construction and have been omitted for reasons of clarity. The second stage 20 consists of the main body 22, the mouthpiece 24 and the exhaust port 25.

As shown in the drawings, the mouthpiece 24 is semicylindrical in shape, has flanges that are placed between the teeth and lips of the user and are held in place with bits 26 during use thereof. The mouthpiece 24 has an opening which provides a means of supplying air to the diver and the mouthpiece 24 is located in upper rear portion of the main body 22.

The exhaust port 25 is generally tubular in configuration and has openings at either end to permit exhaled air to escape regulator 20 into surrounding water and it is in place in lower area of main body.

In accordance with the present invention, the case 28 is of the same configuration as the second stage breathing apparatus 20 and has specified areas for each of the three main parts of the regulator, and this opening is made possible by means of integral hinge 30 which joins the sections 33 and 35 together.

The case 28 is held closed by a common velcro strap 31 until ready for use and the strap 31 is adapted to co-act with a velcro strap portion 32. The excess length 60 of the velcro strap 31 is provided as a convenient finger engaging portion to provide quick opening in an emergency situation. With the box top 23 laid into place in the designated area, a diver need only close the piece 28 to therefore cause the mouthpiece 24 and the exhaust ports to correctly fit into place in the previously described areas or portions.

It will therefore be seen that there has been provided a protective case for a second stage breathing apparatus and wherein the case of the present invention is constructed so that it completely covers the second stage of the breathing apparatus. Because most second stages are very similar in shape or configuration, a case with the same configuration will prove to be the most advantageous shape. Each basic piece of the regulator has a designated area of insertion due to this basic construction. The hinge 30 on the bottom permits the case 28 to be opened widely, and by fitting to any one of the pieces in place a diver need only close the case for proper placement. The velcro straps 31 and 32 are adapted to be used for holding the case closed, and the velcro straps are arranged opposite the hinge portion 30. The "D"-ring 40 permits a diver to fasten the case 28 to a belt or strap worn while diving. The "D"-ring 40 is adapted to be molded into or embedded into case, whereby the case is useful for keeping clean an auxiliary breathing apparatus while underwater. The velcro closures 31 and 32 will hold the case closed securely, but permit quick access to the auxiliary breathing apparatus in the event of an emergency.

Attention is directed to prior U.S. Pat. No. 4,079,735, and the protective case of the present invention is safer because it completely covers the second stage of a regulator so that it will keep the entire second stage free of foreign matter. In prior U.S. Pat. No. 4,079,735 to Gaffney, only the mouthpiece of the second stage is covered.

Further, the regulator 20 is one of the most expensive and delicate pieces of equipment divers will buy, and protection is needed for its appearance and proper functioning. The present invention accomplishes the job by completely covering the second stage and guards the second stage against scratches and dents. Again, U.S. Pat. No. 4,079,735 only covers the mouthpiece and can do nothing to save the appearance of the second stage.

Further, the present invention can be used with both standard second stage and an emergency second stage, whereas prior U.S. Pat. No. 4,079,735 is used only with emergency second stage equipment.

Next, the protective case of the present invention provides additional protection on the beach to guard against sand and rocks and accidental dropping of the same. Further, the protective case is adopted to be used while in the gear bag during transportation or storage of the equipment.

It will therefore be seen that there has been provided a protective case for enclosing a second stage breathing apparatus commonly used for underwater scuba diving and having a thick material of elastomeric composition extending over and encompassing irregular and non-rectilinear structures and thereby forming hollow protuberances having at one location thereof an opening for exiting an air hose, and a slit extending circuitously over about 180–190 degree sector of the case and primarily extending along crevices and concave surfaces thereof except at the terminal portion thereof where the slit extends along a convex type surface. The case is provided with a D-shaped ring for securing hooks and other means onto the case, and a velcro fastener element is provided along an intermediate section of the slit for providing a closure and quick access to the contents upon opening thereof. The material may be relatively thick and of foam material, a solid plastic type material and any generally resilient, non-tearable and flexible material.

The present invention relates to underwater scuba diving equipment casings or protective devices and more particularly the invention relates to a protective device used for encompassing or enclosing a second stage breathing apparatus for keeping it clean and protecting it from the elements, whether above the water or under the water, and completing enclosing the device from all manners of physical abuse and damaging situations.

There has been found significant needs for providing protection to a second stage breathing apparatus on the field, whether above water or below water levels. The device provides a frangible, resilient and recoverable cover or protection case for second stage breathing apparatuses. Since most second stages are very similar in shape, a protective case with a common or similar configuration proves to be of great utility and design and including ornamental designs. Each basic piece of the regulator forming the breathing apparatus will have a designated area of insertion in the case due to the usefulness of the protective case. There are no straight or generally rectangular orthogonal lines in the casing and it leads itself to difficulty in providing a hinge along any two points of the surface that provides ease in opening and closing of such a container or case. The resiliency and infrangibility of the material in iteself provides a hinge on the bottom of the protective case allowing the case to be opened widely for fitting any one of the several pieces comprising the breathing apparatus into place, and a diver would only need to close the case for proper placement and then securing it closed by use of the velcro closure member. A "D"-shaped ring attached to a portion of the surface of the protective case distal from the opening permits the diver to attach the protective case to a belt or strap worn by him or her during diving and making the case useful for keeping clean and protecting it as an auxiliary second stage breathing apparatus while underwater. The velcro closures will hold the case securely closed but will allow quick access to the auxiliary breathing apparatus in case of emergency. The opening is formed by a slit extending about 180–190 degrees along the surface of the case, the slit extending primarily along crevices and concave surfaces of the protective case except at the terminal portions where the slit extends along a convex type surface thereof serving as a significant hinge function.

Figure 2:
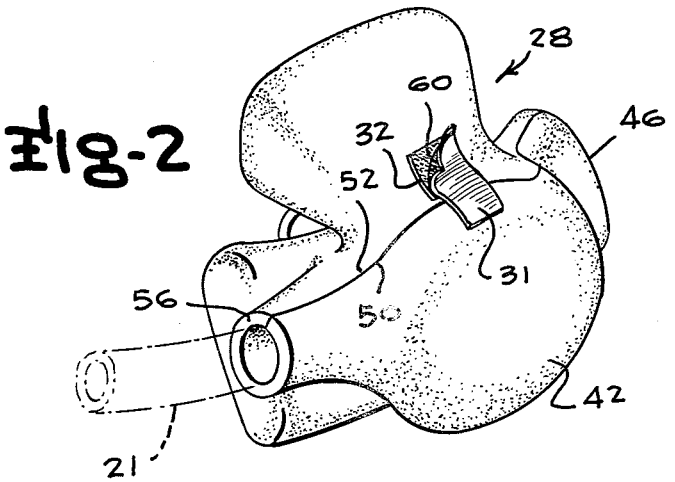
FIG. 2 is a perspective view showing the case in closed position.
Figure 3:
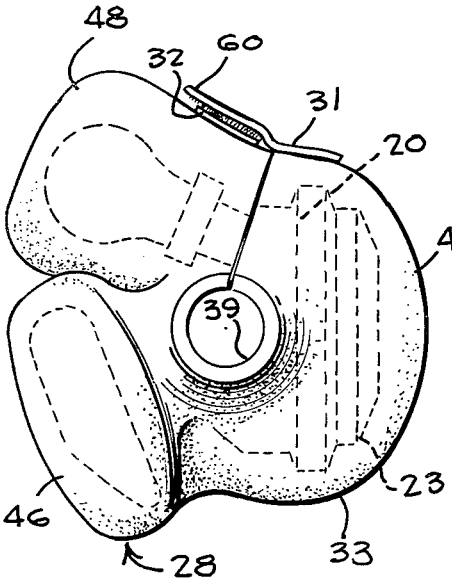
FIG. 3 is a side elevational view of the case.
Figure 4:
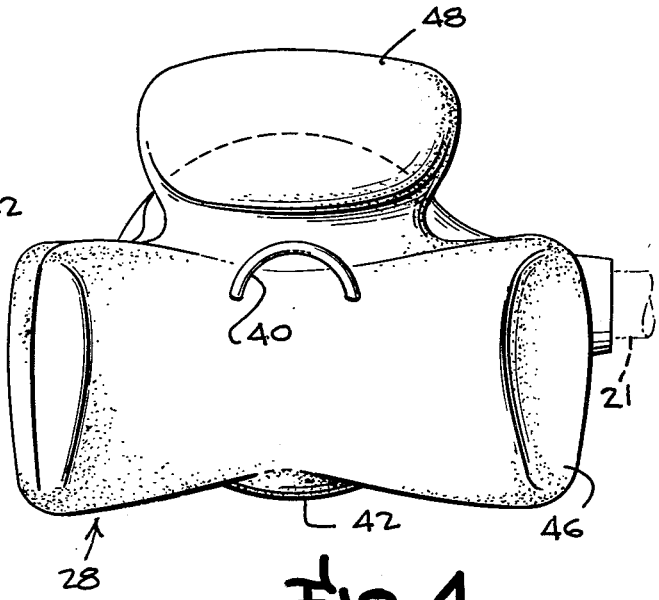
FIG. 4 is a rear elevational view of the case.
Figure 5:
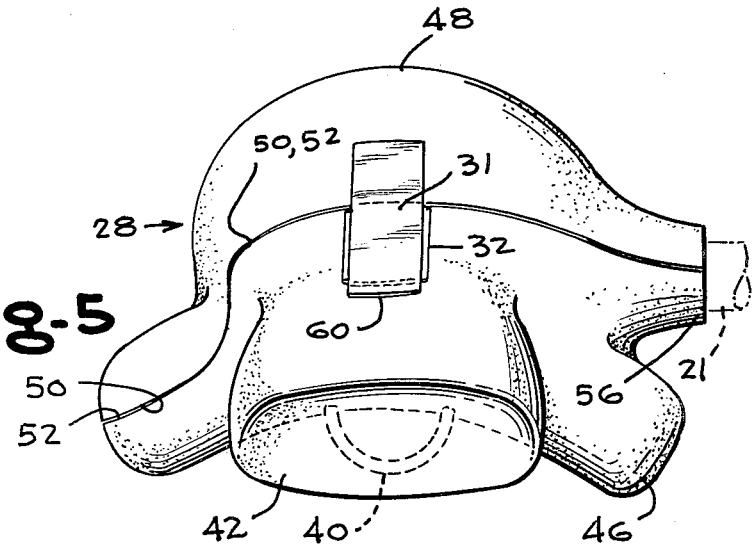
FIG. 5 is a top plan view of the protective case for a second stage breathing apparatus of the present invention.

With further reference to the drawings, there is shown a second stage breathing apparatus 20 having a supply of air available through an air hose 21 leading from a first stage connected to a standard tank of air worn by a diver on his or her back (not shown) and in which the first stage and tank are of conventional construction and utility. The second stage breathing apparatus 20 consists of a main body 22 containing principal components and working parts thereof, including being coupled to the mouthpiece portion 24, a box top portion 23, and an exhaust port 25. The mouthpiece portion 24 is of a semi-cylindrical configuration in shape, having flanges so that they are capable of being placed between the teeth and the lips of the user and so being held in place with bits 26 during use. The mouthpiece portion 24 also contains an opening of conventional nature (not shown) as a means of supplying air to the diver in the usual way. The mouthpiece portion 24 is located in an upper rear portion of the main body 22. The box top 23 is a round and somewhat saucer shaped member and having a plurality of oval water inlet ports 27 surrounding the outer region or periphery of the box top. The box top is usually located in the forward part of the main body 22. Thus, the second stage breathing apparatus is realized as having a distinctive configuration, and therefore is provided a protective case 28 having a resembling configuration as the second stage breathing apparatus 20 in which there are specified areas for each portion of the regulator, such that the box top 23 fits in mating relation into a box top receiving space 42, the air hose fits through an air hose receiving opening 39, the exhaust port 25 is received within an exhaust port receiving space 46 and the mouthpiece 24 is refitted within a mouthpiece receiving 48. The protective case is seen to thus encompass and enclose these stated contours and configurations of the second stage breathing apparatus 20 and there is provided an elongated opening or slit 50, 52 having ends or terminal portions 54 formed at one end of the protective case while the other and terminal end 56 is formed about a mating slit of the air hose exit opening 39, as shown in FIGS. 1 and 2. The protective case is of material such as rubber, a flexible material of plastic or other elastomeric composition and may be of foam material for providing floatation purposes, if desired. The protective case 28 is normally held closed due to the resiliency and flangibility of the material and is secured in a closed position by a common velcro strap members 31 and 32 which provide a closure strap and easy or quick access to the interior of the protective case 28 when ready for use. Sufficient length 60 of velcro member is provided for quick opening in an emergency situation such as when under water, a diver need only close the case and automatically the mouthpiece and exhaust ports are correctly capable of being fitted into place for use as desired.

The length of the slit extends circuitously over a sufficient length of the protective case for about 180–190 degree sector of the case and its intermediate portion is seen to extend primarily along crevices and concave surfaces of the protective case except at the terminal portions thereof, the slit extends along a convex type surface of the case 20.

A D-shaped ring 40 is available so that its circular portion extends outwardly of the protective case.

It is to be understood that the invention is not limited to the specific embodiment herein illustrated and described, but may be used in other ways without departure from its spirit as defined by the following claims.

What is claimed:

1. As a new article of manufacture, a protective case for a second stage breathing apparatus, such case being made of yieldable material and comprising a body member including first and second sections joined together by a hinge portion, flange portions on certain of said second sections, and said flange portions abutting each other when the sections are closed together, there being a recess in one side of the case for the projection therethrough of a hose of a second stage breathing apparatus, there being recessed areas within said first and second sections for receiving the components of a second stage breathing apparatus, and fastener means for selectively retaining and maintaining the sections in closed position.

2. The structure as defined in claim 1 and further including a "D"-ring molded in said protective case.

3. The structure as defined in claim 2 wherein the fastener means include co-acting velcro strips.

4. The structure as defined in claim 3 wherein the case has specified areas for each of the main parts of the second stage breathing apparatus regulator to be placed positioned therein.

5. The structure as defined in claim 4 wherein the velcro strap has an extended portion thereon providing a convenient handgrip for quick opening in an emergency situation.

6. The structure as defined in claim 5 wherein the case is constructed so that it completely covers and encompasses the second stage of a breathing apparatus.

7. The structure as defined in claim 6 wherein the hinge portion of the bottom of the case permits the case to be opened widely whereby fitting any one of the pieces of the second stage breathing apparatus therein, a diver need only close the case for proper placement.

8. In a protective case for a second stage breathing apparatus, a body member made of one piece material having a generally resilient yieldable construction, a hinge portion on said body member, fastener means for selectively retaining the case in closed position, and ring means for permitting the case to be attached to a belt, strap or the like that is worn while diving.

9. In a protective case for a second stage breathing apparatus, said second stage breathing apparatus comprising a hose leading from a first stage connected to a storage tank of air worn by the diver on the back, said second stage comprising a main body containing three main components integral with the body, said three main components comprising a box top, mouthpiece, and exhaust port; said mouthpiece being semi-cylindrical in configuration, said mouthpiece being located in the upper rear portion of the main body; said box top having a generally saucer shape and having oval water inlet ports surrounding the outer region thereof; said box top being located in the forward part of the main body; said exhaust port being tubular in shape and having openings in either end to prevent exhaled air to escape the regulator into the surrounding water; said case having the same configuration as the second stage breathing apparatus and having specified areas for each of the three main parts and components of the regulator to be place therein; there being open areas in the case permitting insertion of the regulator; and a hinge permitting the case to be opened and closed; velcro strap means for selectively retaining the case in closed position; said case completely covering second stage breathing apparatus; the hinge permitting the case to be opened widely so that by fitting any one of the pieces in place a diver would need to close the case for proper placement; and ring means molded into the case permitting the diver to attach the case to a belt or strap worn while diving so that the case can be used for keeping clean and protecting an auxiliary breathing apparatus while under water.

10. A protective case for enclosing a second stage breathing apparatus commonly used in underwater scuba diving, said protective case comprising a thick material of elastomeric composition extending over and encompassing irregular and non-rectilinear structures and forming a hollow protuberance having at one location for exiting an air hose, and a slit extending circuitously over about a 180–190 degree section of the case, and primarily extending along crevices and concave surfaces thereof except at terminal portions thereof where the slit extends along a convex type surface.

11. The invention of claim 10 wherein a "D"-shaped ring is disposed within the cover having its semicircular portion protruding freely therefrom and being positioned intermediate to terminal portions of the slit, and also positioned in another crevice and concave surface thereof.

12. The invention of claim 10 wherein velcro fastener elements are secured at the edges of said slit for providing a closure and for quick access to the contents of the case.

13. The invention defined in claim 10 wherein the material is a foam.

14. The invention of claim 10 wherein convex surface portions of the case are respective container spaces for a box top receiving portion, a mouthpiece receiving portion, exhaust port receiving portions, and an air hose exiting portion for a second stage breathing apparatus.

15. A protective case for enclosing breathing apparatus commonly used in underwater scuba diving, the protective case comprising a covering of thick material and elastomeric composition extending over and encompassing an irregular and non-rectilinear structure forming a hollow therein for a receiving a breathing apparatus, a slit extending circuitously over about a 180–190 degree sector of the case having its primary portion thereof extending along crevices and concave surfaces of the protective case, the terminal portions of the slit extend along a convex surface thereof, a supporting ring extending from a portion of the protective case distal from the slit, and a velcro fastener element disposed intermediate into the ends of the slits for securely holding the protective case closed until quick access to the contents of the protective case is desired.

16. The invention, according to claim 15 wherein the configuration of the protective case has convex portions for enenclosing a box top or said apparatus, a mouthpiece of said apparatus, an exhaust port of said apparatus, and an air hose of said apparatus including an exiting opening for said air hose, said exiting opening for the air hose also providing a terminal end for the slit whereby the air hose can be readily withdrawn from the protective case accordingly.

17. The invention of claim 15 wherein the material forming the protective case is an elastomeric material.

18. The invention according to claim 15 wherein the like material is a resilient foam material.

* * * * *